US008857934B2

(12) United States Patent
Hirayama

(10) Patent No.: US 8,857,934 B2
(45) Date of Patent: Oct. 14, 2014

(54) PRINT ELEMENT SUBSTRATE, PRINTHEAD, AND PRINTING APPARATUS

(71) Applicant: Canon Kabushiki Kaisha, Tokyo (JP)

(72) Inventor: Nobuyuki Hirayama, Fujisawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/743,647

(22) Filed: Jan. 17, 2013

(65) Prior Publication Data

US 2013/0208037 A1 Aug. 15, 2013

(30) Foreign Application Priority Data

Feb. 10, 2012 (JP) ..... 2012-027722

(51) Int. Cl.
*B41J 29/38* (2006.01)
*B41J 2/045* (2006.01)

(52) U.S. Cl.
CPC ..... *B41J 2/04501* (2013.01); *B41J 2/04541* (2013.01); *B41J 2/0458* (2013.01); *B41J 2/04543* (2013.01); *B41J 2/04563* (2013.01)
USPC ..... 347/9

(58) Field of Classification Search
CPC .. B41J 2/04541; B41J 2/0458; B41J 2/04501; B41J 2/04581; B41J 2/04588; B41J 2/04543
See application file for complete search history.

(56) References Cited

U.S. PATENT DOCUMENTS

| | | | | |
|---|---|---|---|---|
| 7,029,081 | B1 | 4/2006 | Imanaka | |
| 7,597,424 | B2 | 10/2009 | Hirayama | |
| 2012/0306953 | A1 * | 12/2012 | Kanno et al. | 347/11 |

FOREIGN PATENT DOCUMENTS

| | | | |
|---|---|---|---|
| JP | 10-250159 | A | 9/1998 |
| JP | 2000-198202 | A | 7/2000 |
| JP | 2001-80060 | A | 3/2001 |

* cited by examiner

*Primary Examiner* — Lisa M Solomon
(74) *Attorney, Agent, or Firm* — Fitzpatrick, Cella, Harper & Scinto

(57) ABSTRACT

This invention provides a print element substrate having a plurality of printing elements. The print element substrate includes a detection circuit configured to detect substrate information of the print element substrate, a shift register configured to serially input print signals for performing driving control of the printing elements, serial-parallel convert the print signals, and parallelly output the print signals, a latch circuit configured to latch the print signals parallelly output from the shift register, and a driving circuit configured to drive the plurality of printing elements based on the print signals latched by the latch circuit. Detection signals based on the substrate information are parallelly input from the detection circuit to the shift register until serial input of next print signals starts after parallelly outputting the print signals from the shift register to the latch circuit.

5 Claims, 11 Drawing Sheets

PRINT ELEMENT SUBSTRATE, PRINTHEAD, AND PRINTING APPARATUS

BACKGROUND OF THE INVENTION

1. Field of the Invention

The present invention relates to a print element substrate, printhead, and printing apparatus.

2. Description of the Related Art

There is known a printing apparatus which employs an inkjet printing system. The printing apparatus of this system generally includes a printhead in which a plurality of printing elements are arrayed. The printing apparatus prints an image by scanning the printhead with respect to a printing medium.

Japanese Patent Laid-Open No. 2001-080060 discloses a method of inputting serial data for driving a printing element in a printhead, and serially outputting digital information such as temperature data and head characteristic information.

In this method, the printhead includes an input shift register for inputting serial data for driving a printing element, and an output shift register for digitalizing temperature data in the printhead and serially outputting it.

However, in Japanese Patent Laid-Open No. 2001-080060, two shift registers, that is, an input shift register and output shift register need to be arranged on the same substrate, increasing the circuit scale and substrate size.

In the semiconductor manufacturing process, the substrate size needs to be decreased to increase the number of substrates obtained from a single wafer and reduce the cost. Hence, the increase in substrate size raises the cost.

Recently, printheads (substrates) are increasing the number of printing elements and becoming long for higher resolutions and higher speeds. Achieving high-quality printing requires driving control of printing elements in accordance with the temperature distribution within the substrate. Accordingly, temperature detection at a plurality of portions within the substrate becomes necessary.

When a plurality of temperature detection circuits are arranged in the substrate, wiring lines for outputting detection information also become long along with the elongation of the substrate, increasing the wiring area inside the substrate. This also leads to a large substrate size.

The present invention has been made to solve the above problems, and has as its object to provide a technique for suppressing the circuit scale of a print element substrate for outputting substrate information, and implementing shrinkage of the substrate size.

SUMMARY OF THE INVENTION

Accordingly, the present invention is conceived as a response to the above-described disadvantages of the conventional art.

For example, a print element substrate, printhead, and printing apparatus according to this invention are capable of providing a technique for suppressing the circuit scale of a print element substrate for outputting substrate information, and implementing shrinkage of the substrate size.

According to one aspect of the present invention, there is provided a print element substrate including a plurality of printing elements, comprising: a detection circuit configured to detect substrate information of the print element substrate; a shift register configured to serially input print signals for performing driving control of the printing elements, serial-parallel convert the print signals, and parallelly output the print signals; a latch circuit configured to latch the print signals parallelly output from the shift register; and a driving circuit configured to drive the plurality of printing elements based on the print signals latched by the latch circuit, wherein detection signals based on the substrate information are parallelly input from the detection circuit to the shift register until serial input of next print signals starts after parallelly outputting the print signals from the shift register to the latch circuit.

According to one aspect of the present invention, there is provided a print element substrate comprising: a printing element; a driving unit configured to drive the printing element based on print data; an obtain unit configured to obtain information of the print element substrate; a transfer unit, including a holding area for holding data, configured to serially receive the print data from outside the print element substrate while serially transmitting information held in the holding area to outside the print element substrate, and store the received print data in the holding area; a latch unit configured to latch the print data held in the holding area; and a storing unit configured to write the information obtained by the obtain unit in the holding area before performing next transmission by the transfer unit after the latch unit latches the print data.

Further features of the present invention will become apparent from the following description of exemplary embodiments (with reference to the attached drawings).

DESCRIPTION OF THE EMBODIMENTS

An exemplary embodiment of the present invention will now be described in detail according to the accompanying drawings. In the following description, a printing apparatus using an inkjet printing system will be exemplified. The printing apparatus may be, for example, a single-function printer having only a printing function, or a multi-function printer having a plurality of functions such as a printing function, FAX function, and scanning function. The printing apparatus may be a manufacturing apparatus for manufacturing, by a predetermined printing method, a color filter, electric device, optical device, micro structure, and the like.

In this specification, the terms "print" and "printing" not only include the formation of significant information such as characters and graphics, but also broadly includes the formation of images, figures, patterns, and the like on a print medium, or the processing of the medium, regardless of whether they are significant or insignificant and whether they are so visualized as to be visually perceivable by humans.

Also, the term "print medium" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be extensively interpreted similar to the definition of "print" described above. That is, "ink" includes a liquid which, when applied onto a print medium, can form images, figures, patterns, and the like, can process the print medium, and can process ink. The process of ink includes, for example, solidifying or insolubilizing a coloring agent contained in ink applied to the print medium.

Further, the term "printing element" (to be also referred to as a "nozzle") generically means an ink orifice or a fluid channel communicating with it, and an element which generates energy used to discharge ink, unless otherwise specified.

(First Embodiment)

Figure 1:
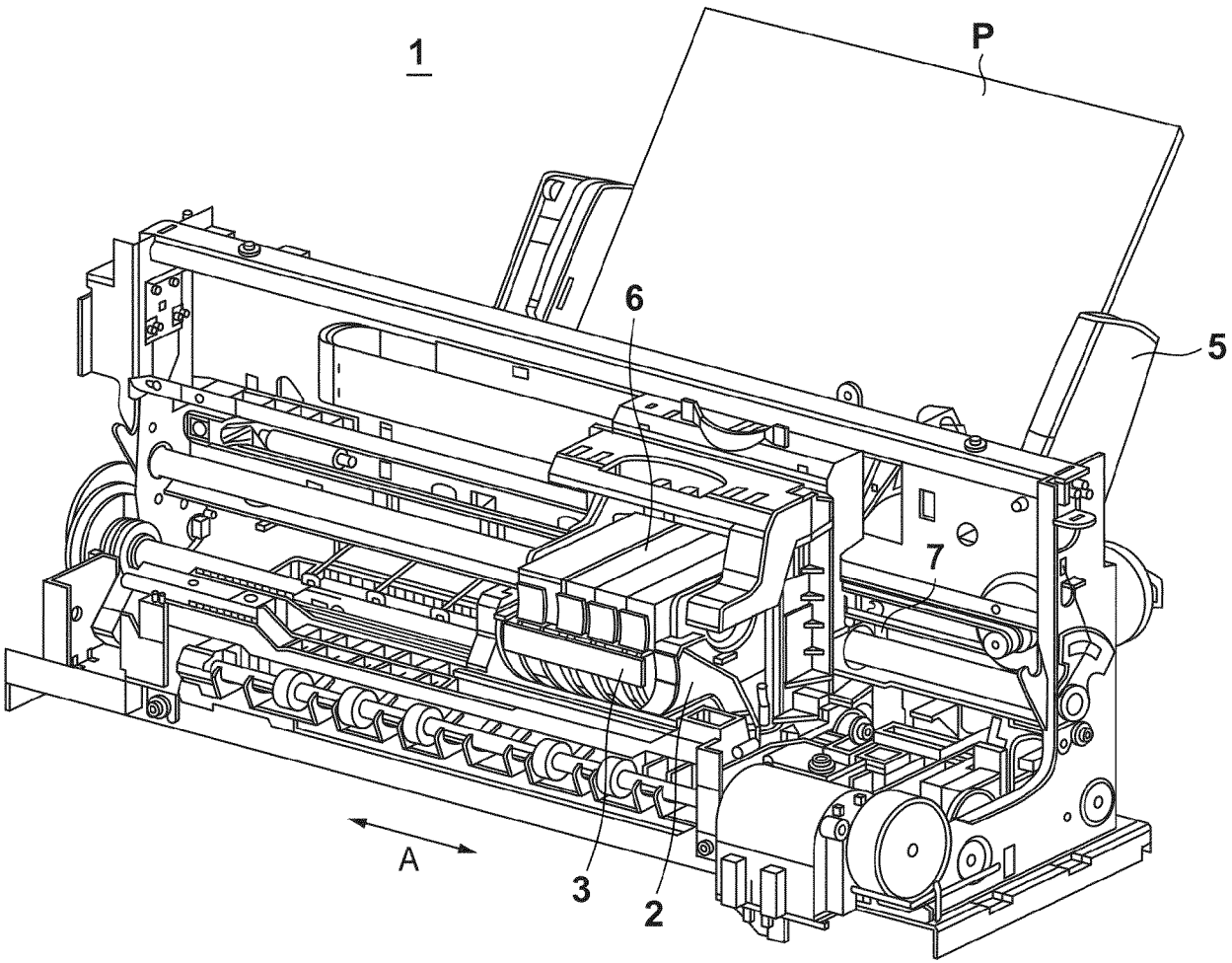
FIG. 1 is a perspective view showing an inkjet printing apparatus 1 according to an embodiment of the present invention.

FIG. 1 is a perspective view showing an inkjet printing apparatus (to be referred to as a printing apparatus hereinafter) 1 according to an embodiment of the present invention.

In the printing apparatus 1, an inkjet printhead (to be referred to as a printhead hereinafter) 3 for discharging ink according to an inkjet method to print is mounted on a carriage 2. The carriage 2 reciprocates in directions (scanning directions) indicated by an arrow A to print. The printing apparatus 1 feeds a printing medium P via a sheet supply mechanism 5, and conveys it to a printing position. At the printing position, the printhead 3 discharges ink onto the printing medium P, thereby printing.

In addition to the printhead 3, for example, ink cartridges 6 are mounted on the carriage 2 of the printing apparatus 1. Each ink cartridge 6 stores ink to be supplied to the printhead 3. The ink cartridge 6 is detachable from the carriage 2.

The printing apparatus 1 shown in FIG. 1 is capable of color printing. For this purpose, four ink cartridges which contain, for example, magenta (M), cyan (C), yellow (Y), and black (K) inks are mounted on the carriage 2. These four ink cartridges are independently detachable.

A print element substrate (to be also simply referred to as a substrate hereinafter) 3 is arranged on the printhead 3. A plurality of nozzle arrays are arranged on the substrate. The printhead 3 adopts, for example, an inkjet method of discharging ink using thermal energy. The printhead 3 includes printing elements each formed from a heat generation element (so-called heater) and the like, and a control circuit for performing heater driving control. The heaters are arranged in correspondence with respective nozzles (orifices), and a pulse voltage is applied to a corresponding heater in accordance with a print signal. In the embodiment, discharge of ink using the heat generation element will be explained as an ink discharging type, but the present invention is not limited to this. The present invention may employ various inkjet types such as a type using a piezoelectric element, a type using an electro-static element, and a type using a MEMS element.

A recovery apparatus is arranged outside the reciprocal motion range of the carriage 2 (outside the printing area) to cancel a discharge failure by the printhead 3. The position where the recovery apparatus is arranged is called a home position or the like. While no printing operation is performed, the printhead 3 stands still at this position.

The arrangement of the printing apparatus 1 has been exemplified. Note that the arrangement of the printing apparatus 1 shown in FIG. 1 is merely an example, and the printing apparatus 1 is not limited to this arrangement. For example, in the arrangement of FIG. 1, the printing medium P is conveyed with respect to the printhead 3. However, this arrangement is arbitrary as long as the printhead 3 and printing medium P move relatively. For example, the printhead 3 may move with respect to the printing medium P.

Figure 2:
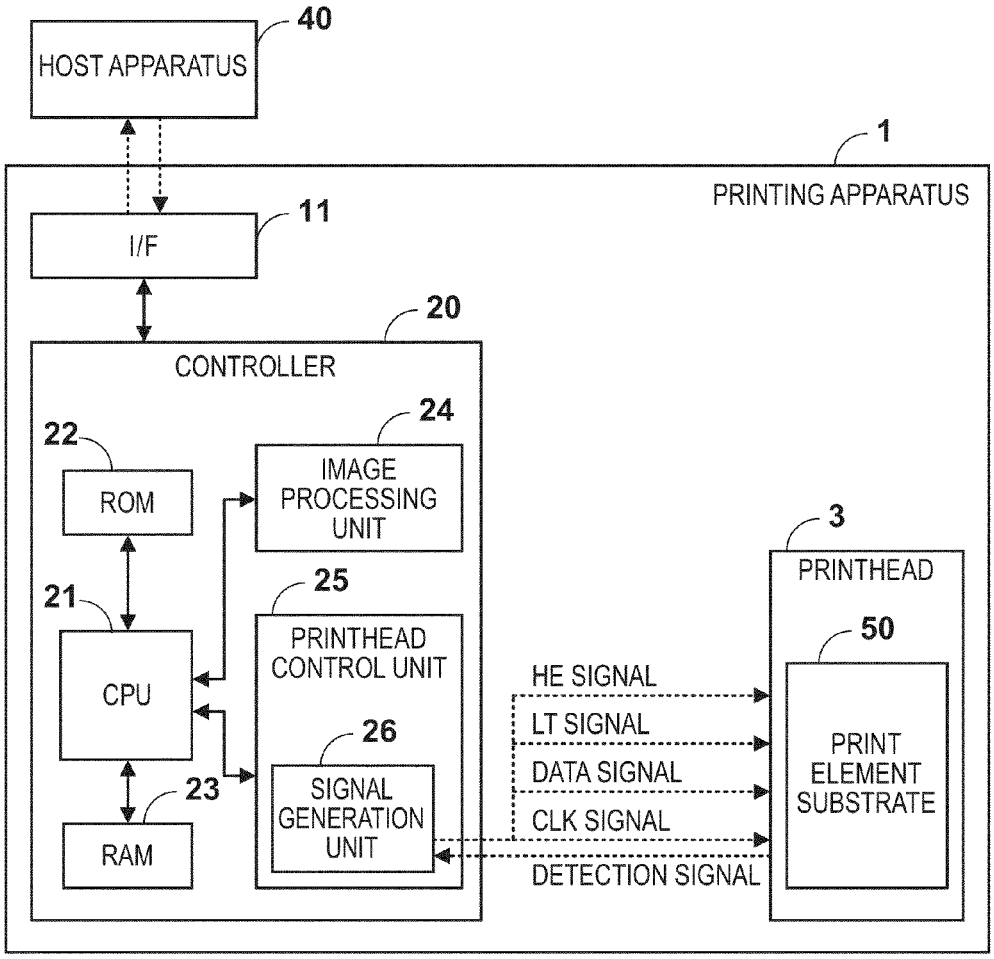
FIG. 2 is a block diagram exemplifying the functional arrangement of the printing apparatus 1 shown in FIG. 1.

FIG. 2 is a block diagram exemplifying the functional arrangement of the printing apparatus 1 shown in FIG. 1.

The printing apparatus 1 is connected to a host apparatus 40. The host apparatus 40 is implemented as a computer (or an image reader, digital camera, or the like) serving as an image data supply source. The host apparatus 40 and printing apparatus 1 exchange image data, commands, and the like via an interface (to be referred to as an I/F hereinafter) 11.

A controller 20 is a so-called control circuit, and includes a CPU (Central Processing Unit) 21, ROM (Read Only Memory) 22, RAM (Random Access Memory) 23, image processing unit 24, and printhead control unit 25.

The CPU 21 comprehensively controls processing in the controller 20. The ROM 22 stores programs and various data. The RAM 23 is used as a work area and temporarily stores various calculation results and the like when the CPU 21 executes a program.

The image processing unit 24 performs various image processes for image data received from the host apparatus 40 via the I/F 11.

The printhead control unit 25 controls the printhead 3. The printhead control unit 25 includes a signal generation unit 26. The signal generation unit 26 generates various signals and transfers the generated signals to the printhead 3. The signals transferred to the printhead 3 are, for example, a serial clock (CLK signal), serial data (DATA signal), latch signal (LT signal), and heat-enable signal (HE signal).

The printhead 3 discharges ink from each orifice in the printhead 3 based on a signal transferred from the printhead control unit 25. The printhead 3 includes a print element substrate 50 on which a plurality of printing elements are arranged, details of which will be described later. The print element substrate 50 transfers substrate information (for example, temperature data) as a detection signal to the printhead control unit 25.

Figure 3:
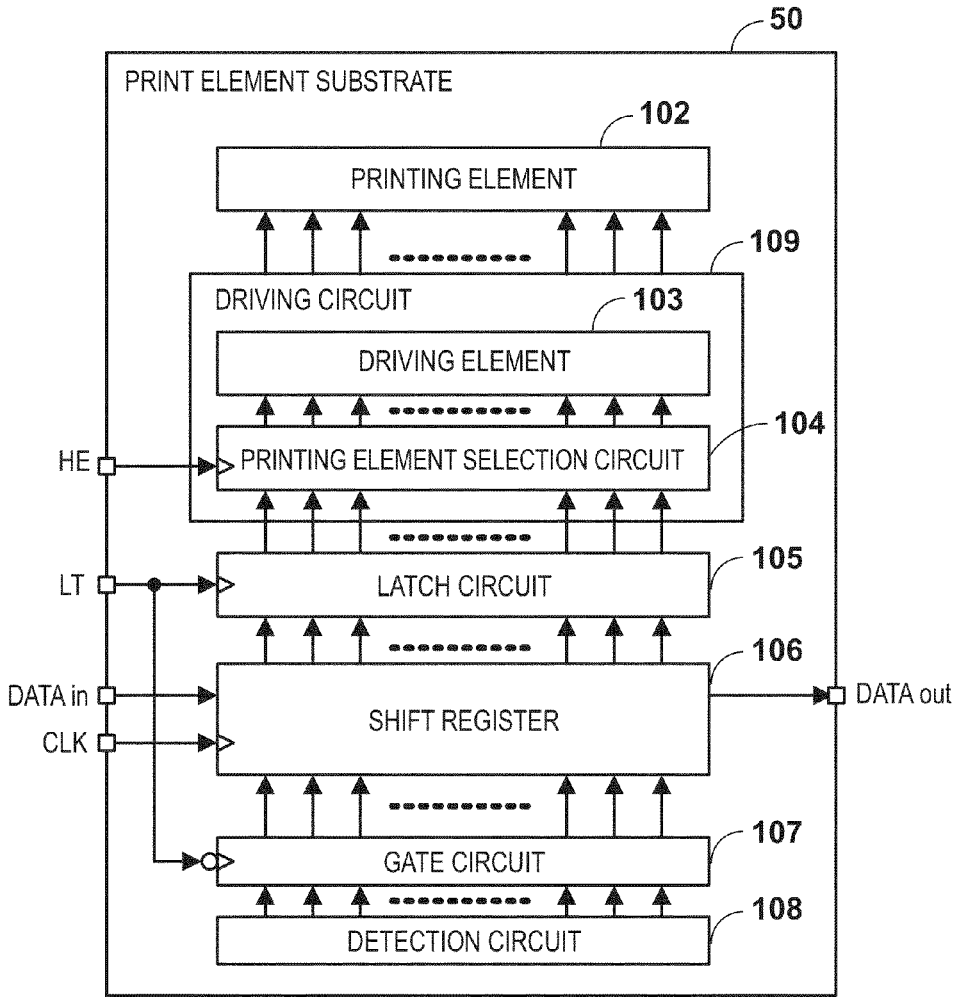
FIG. 3 is a block diagram exemplifying the arrangement of a print element substrate 50 shown in FIG. 2.

FIG. 3 is a block diagram exemplifying the arrangement of the print element substrate 50 shown in FIG. 2. The print element substrate 50 includes a plurality of printing elements 102. By driving the printing elements based on print data, an image is printed on a printing medium.

The print element substrate 50 includes the printing elements 102, latch circuits 105, shift registers 106, gate circuits 107, a detection circuit 108, and a driving circuit 109. Note that the driving circuit 109 includes driving elements 103 and printing element selection circuits 104.

The driving elements (for example, MOS transistors) 103 and printing element selection circuits 104 are arranged in correspondence with the respective printing elements 102. Each driving element 103 drives a corresponding printing element based on a driving signal from the printing element selection circuit 104, thereby discharging ink from a corresponding nozzle. The printing element selection circuit 104 receives the heat-enable signal (HE signal), and a print signal (serial data: DATA signal) (from the latch circuit 105). The printing element selection circuit 104 outputs a driving signal to the driving element 103 based on the logical product of these signals.

A serial data input terminal $DATA_{in}$, clock input terminal CLK, and serial data output terminal $DATA_{out}$ are arranged for the shift registers 106. The shift registers 106 serially receive print signals (serial data) in synchronism with the CLK signal, serial-parallel convert them, and output the print signals to the latch circuits 105.

An LT signal input terminal LT for inputting the LT signal is arranged for the latch circuits 105. The latch circuits 105 parallelly receive print signals (parallel data) from the shift registers 106 in synchronism with the LT signal from the terminal LT. The print signals (parallel data) output from the latch circuits 105 are input to the printing element selection circuits 104. Each printing element selection circuit 104 is connected to a corresponding driving element 103, and the driving element 103 is connected to a corresponding printing element 102.

The detection circuit 108 digitalizes substrate information (for example, temperature data) in the print element substrate 50, and outputs it as a detection signal. The output terminal of the detection circuit 108 is connected to the input terminal of the gate circuit 107.

When an output from a gate terminal Gate (for inputting the LT signal) becomes valid, the gate circuit 107 outputs an output from an output terminal OUT1 or OUT2, and the output is set at each bit of the shift register 106.

Figure 4A:
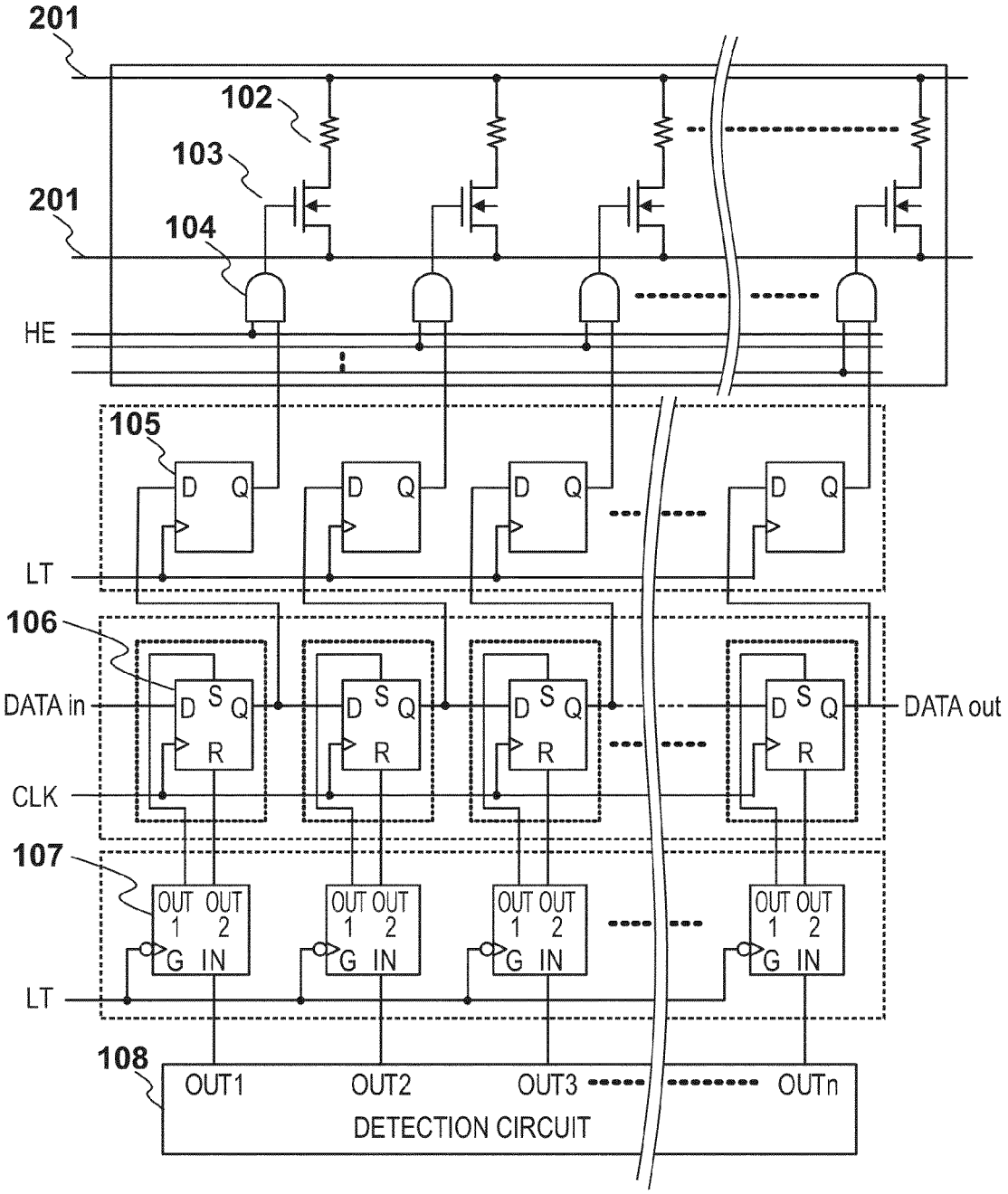
FIG. 4A is a circuit diagram showing the circuit arrangement of the print element substrate 50.

FIG. 4A is a circuit diagram exemplifying the circuit arrangement of the print element substrate 50 shown in FIG. 2. FIG. 4A shows the arrangement of n printing elements and n outputs of the detection circuit. The same reference numerals as those in FIG. 3 denote the same parts.

The printing elements 102, driving elements 103, and printing element selection circuits 104 are serially connected, and the printing elements 102 and driving elements 103 are interposed between power supply lines 201. The control terminal (gate) of each driving element 103 is connected to the printing element selection circuit 104, and the input terminal of the printing element selection circuit 104 is connected to the output terminal of the latch circuit 105.

The input terminal of the latch circuit 105 is connected to the output terminal of the 1-bit shift register 106. The shift register 106 is connected to the output of the gate circuit 107. The input of the gate circuit 107 is connected to the output terminal of the detection circuit 108.

Figure 4B:
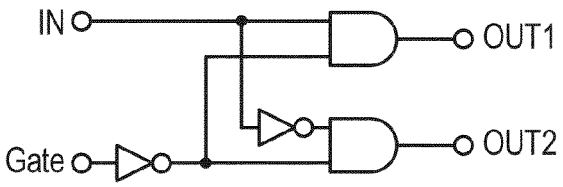
FIG. 4B is a circuit diagram showing the arrangement of a gate circuit 107.

The gate circuit 107 is implemented by, for example, an arrangement shown in FIG. 4B. The gate circuit 107 receives, at the input terminal IN, a detection signal (substrate information) from the detection circuit 108, and outputs an output based on the detection signal from either the output terminal OUT1 or OUT2 to the shift register 106 in response to input of the LT signal to the gate terminal Gate.

The operation of the circuit shown in FIG. 4A will be explained with reference to FIGS. 5A and 5B.

Figure 5A:
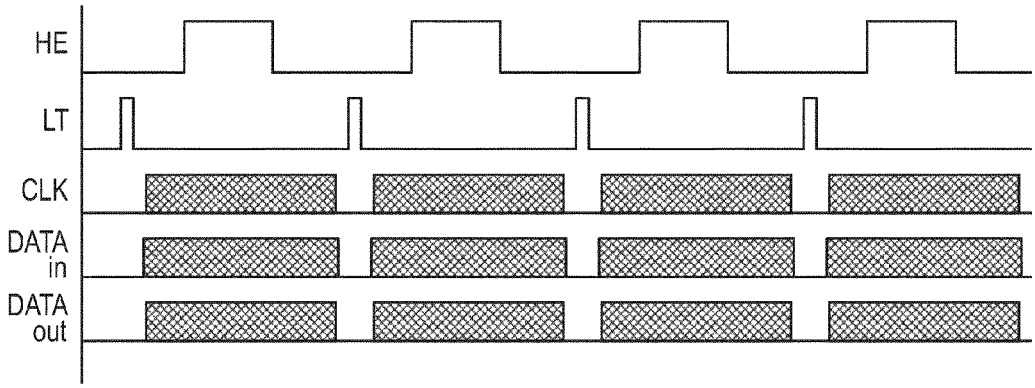
FIGS. 5A and 5B are timing charts for explaining the operation of the circuit shown in FIG. 4A.

FIG. 5A shows the timings of all signals input to the print element substrate 50. HE represents the waveform of the HE signal (from the HE signal input terminal) for driving a printing element. The printing element is driven during the "H (High)" period. LT, CLK, $DATA_{in}$, and $DATA_{out}$ represent the waveforms of signals input from corresponding terminals in FIGS. 1 and 2. In the embodiment, n-bit printing elements are driven.

Figure 5B:
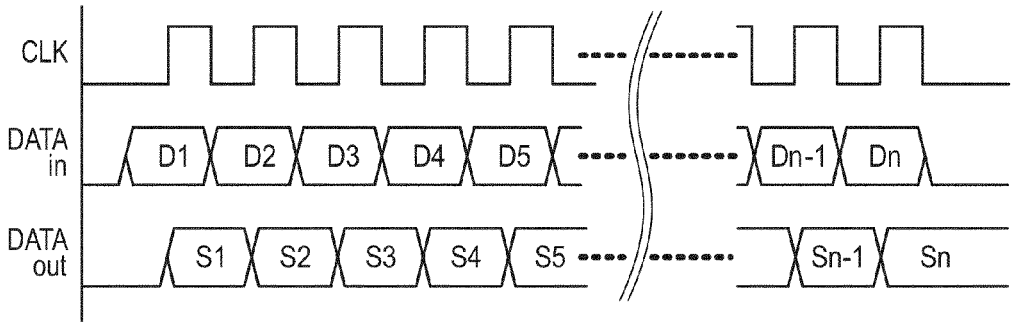

FIG. 5B shows the enlarged time ranges of the CLK signal, $DATA_{in}$ signal, and $DATA_{out}$ signal shown in FIG. 5A.

When driving n-bit printing elements by one data transfer, the $DATA_{in}$ signal is formed from n data for driving n-bit printing elements. The shift registers 106 sequentially receive print signals from the $DATA_{in}$ terminal at transition (leading edge) timings of the CLK signal. In this case, the shift registers 106 receive print signals D1 to Dn in synchronism with leading edges of the CLK signal. Detection signals S1 to Sn input to the shift registers 106 are sequentially output in synchronism with trailing edges of the CLK signal.

An outline of input and output of the print signal and detection signal will be explained with reference to FIG. 6.

During the print signal serial transfer period, print signals are sequentially input to the shift registers 106 in synchronism with timings of the CLK signal. At this time, the print signals are sequentially shift and input to the shift registers 106 of adjacent bits in synchronism with the CLK signal. After inputting n leading edges of the CLK signal, data transfer to the n-bit shift registers 106 is completed.

Upon completion of transferring the print signals to the shift registers 106, the print signals are parallelly output to the latch circuits 105 at trailing edge timing of the LT signal, and latched by the latch circuits 105 (latch period). Upon completion of transfer to the latch circuits 105, outputs (detection signals) from the detection circuit 108 are set at the respective bits of the shift registers 106.

This operation will be described in detail. A detection signal from the detection circuit 108 is first input to the gate circuit 107. Output of the detection signal input to the gate circuit 107 is controlled in accordance with input of a signal from the gate terminal of the gate circuit 107. In the embodiment, an output from the detection circuit 108 to the gate circuit 107 becomes valid in synchronism with the trailing edge of the LT signal.

Each bit of the shift register 106 includes an S (Set) terminal and R (Reset) terminal (see FIG. 4A). When "H (High)" is input to the S terminal, data of the shift register 106 is set to "H". When "H" is input to the R terminal, data of the shift register 106 is set to "L (Low)".

When "H" is input to the gate terminal of the gate circuit 107, "H" is output from either OUT1 or OUT2 as an output from the gate circuit 107, and input to the shift register 106 via the S or R terminal. In this manner, detection signals parallelly sent from the detection circuit 108 are set at the respective bits of the shift registers 106. That is, temperature data from the detection circuit 108 are set in the shift registers 106.

The number of output bits of the detection circuit 108 is also n, which is equal to the number of (simultaneously) driven printing elements. Letting S1 to Sn be the output bits of the detection circuit 108, the detection signals S1 to Sn are set at the respective bits of the shift registers 106 in accordance with trailing edge timings of the LT signal.

Figure 6:
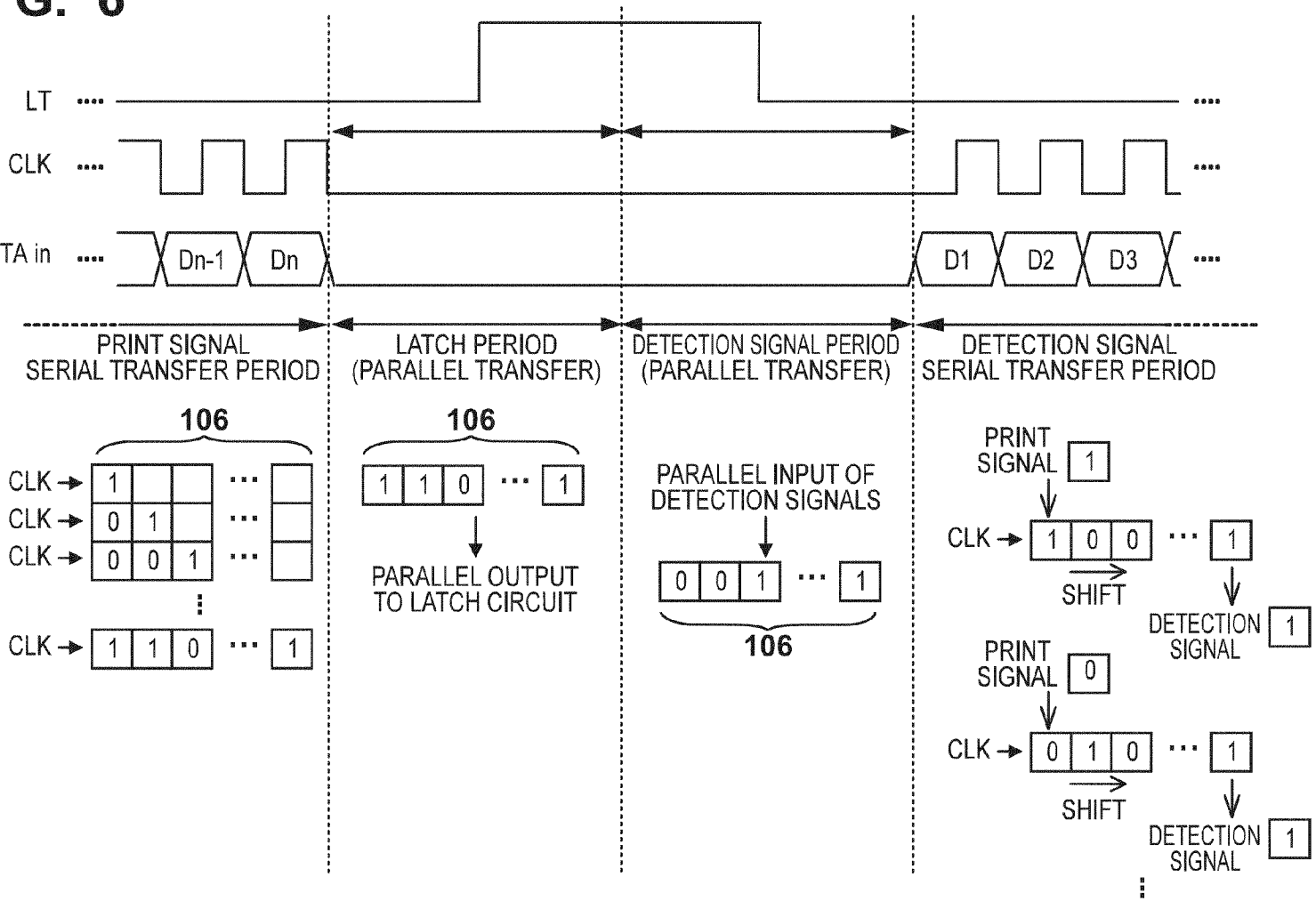
FIG. 6 is a view for explaining an outline of input and output of print data and detection data.

As shown in FIG. 6, CLK neither rises nor falls during the period (latch period) of parallel transfer from the shift registers 106 to the latch circuits 105, and the period (detection data store period) during which detection signals are stored. During these periods, no serial transfer occurs in the shift registers 106. After outputs from the detection circuit 108 are set in the shift registers 106, a leading edge of the CLK signal is input to the clock input terminal CLK of the shift registers 106. In response to this, serial transfer (parallel-serial conversion) of the detection signals by the shift registers 106 starts.

When n leading edges of the CLK signal are input to the shift registers 106, the detection signals S1 to Sn are serially output in turn from the $DATA_{out}$ terminal serving as the output terminal of the shift registers 106 (to the outside (the controller 20)). At the same time, print signals are serially input in turn from the $DATA_{in}$ terminal serving as the input terminal of the shift registers 106.

By repeating this operation, output of the bits S1 to Sn serving as substrate information and input of driving data D1 to Dn for the printing elements 102 can be continuously performed.

Figure 9:
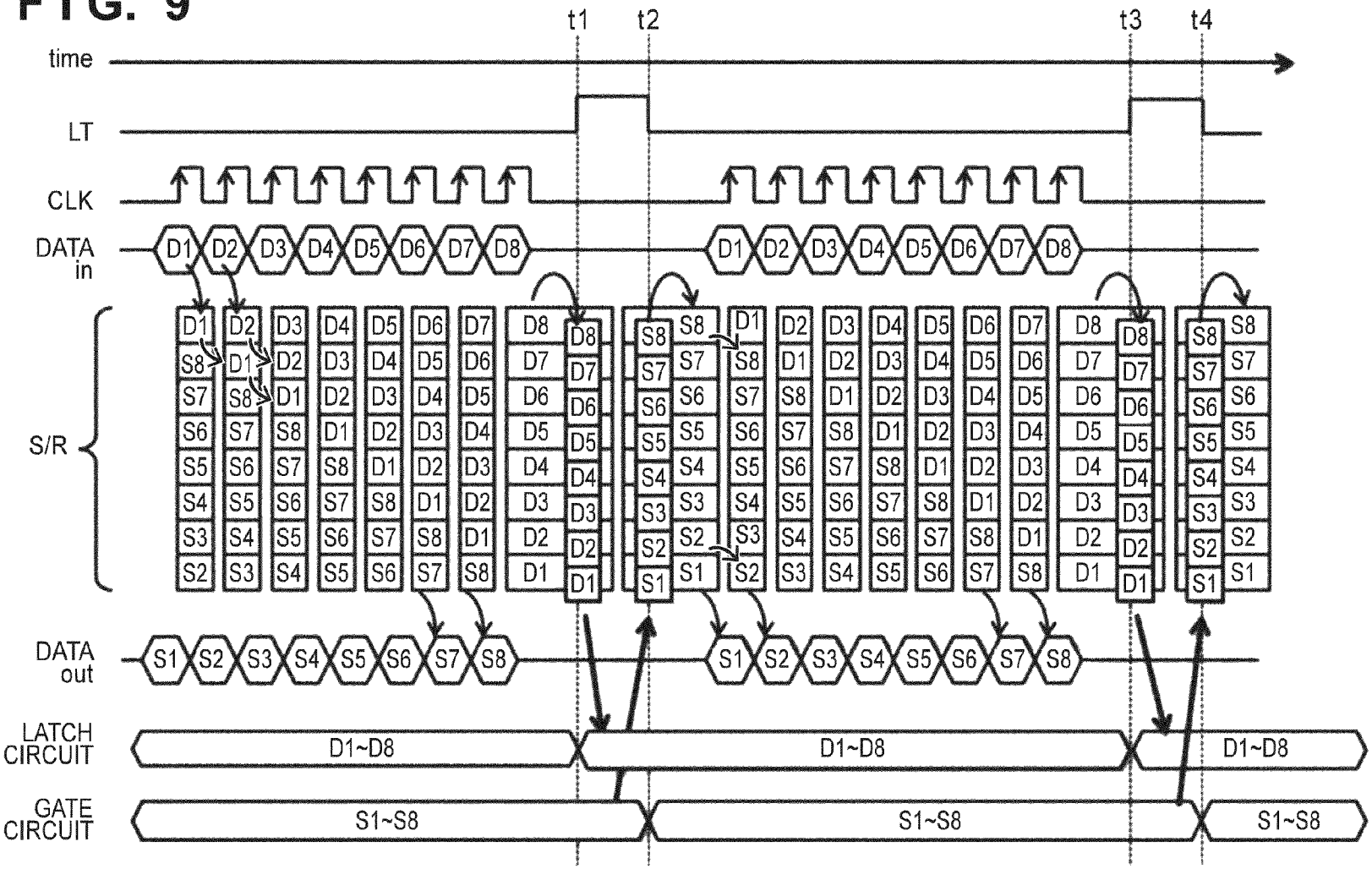
FIG. 9 is a view for explaining an outline of input and output of print data and detection data.

A supplementary explanation of FIG. 6 will be given with reference to FIG. 9. FIG. 9 shows a state in which data transfer of 8 bits S1 to S8 from the gate circuits 107 to the shift registers 106 and data transfer of 8 bits D1 to D8 from the shift registers 106 to the latch circuits 105 are performed continuously. The shift registers 106 transfer data D1 to D8 to the latch circuits 105 in synchronism with the leading edge of the LT signal at timing t1. The gate circuits 107 transfer data S1 to S8 to the shift registers 106 in synchronism with the trailing edge of the LT signal at timing t2. Data D1 to D8 are input bit by bit to the shift registers till timing t1. Data S1 to S8 are output from the shift registers 106, and data D1 to D8 are input to the shift registers 106 in the period between timing t2 and timing t3.

After the timing when print signals (printing element driving data) serially input to the shift registers 106 are output to the latch circuits 105, detection signals from the detection circuit 108 are parallelly input to the shift registers 106. In the shift register 106, the print signal and detection signal do not interfere with each other, and these signals can be interchanged and stored.

As described above, according to the first embodiment, input of a print signal and output of substrate information are performed using a common shift register. The first embodiment can therefore suppress the circuit scale of the print element substrate and implement shrinkage of the substrate size.

According to the first embodiment, the timing to parallelly output, to the latch circuits, print signals serially input to the shift registers, and the timing to parallelly input detection signals from the detection circuit to the shift registers are adjusted based on only the latch signal. Compared to controlling these timings using dedicated signals, the numbers of signal wiring lines and input terminals can be decreased, implementing shrinkage of the substrate size and reduction of the substrate cost.

Further, the input and output timings of the shift register are controlled by one signal. Compared to controlling these timings using two signals, the timing margin for preventing interference between input and output in the shift register can be decreased. As a result, the time taken for transfer can be shortened, increasing the data transfer rate.

Figure 10:
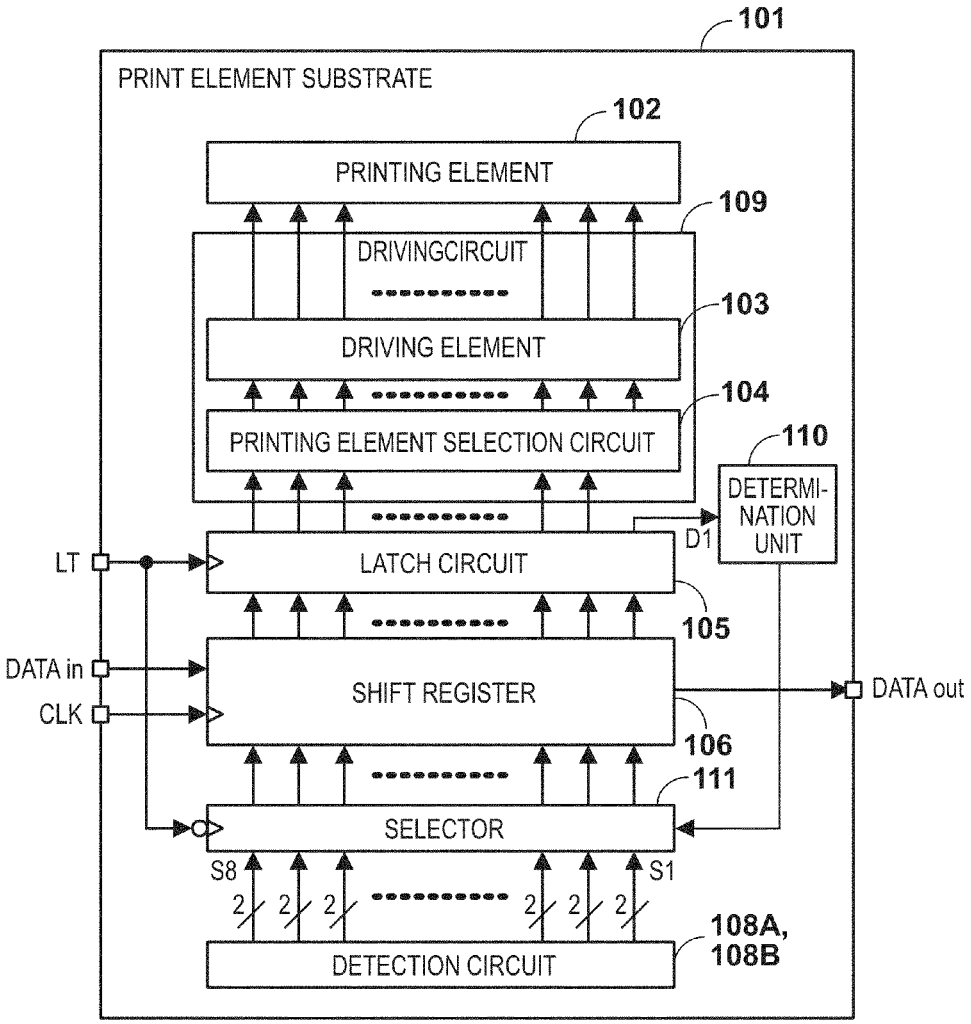
FIG. 10 is a block diagram for explaining the first modification of the circuit arrangement of the print element substrate 50 according to the first embodiment.

FIG. 10 shows the first modification of the print element substrate 50 according to the first embodiment. As shown in FIG. 10, a print element substrate 101 as the first modification of the print element substrate 50 includes two types of detection circuits 108A and 108B, a selector 111, and a determination unit 110. As described with reference to FIG. 9, each of the detection circuits 108A and 108B outputs data S1 to S8 of 8 bits. For example, S1 is output from each of the detection circuits 108A and 108B, and the selector 111 in FIG. 10 receives the 2-bit signal S1. This also applies to S2 to S8. The detection circuits 108A and 108B are, for example, temperature detection circuits.

The selector 111 receives signals output from the two types of detection circuits 108A and 108B, and selects a signal to be output to the shift register 106 from these signals based on a signal generated by the determination unit 110. The determination unit 110 receives data D1 from the latch circuit 105 and generates, based on the value of data D1, a signal for controlling the selector 111. For example, if the D1 value is 0, the determination unit 110 outputs a signal to select the detection circuit 108A by the selector 111. If the D1 value is 1, the determination unit 110 outputs a signal to select the detection circuit 108B by the selector 111.

Figure 11:
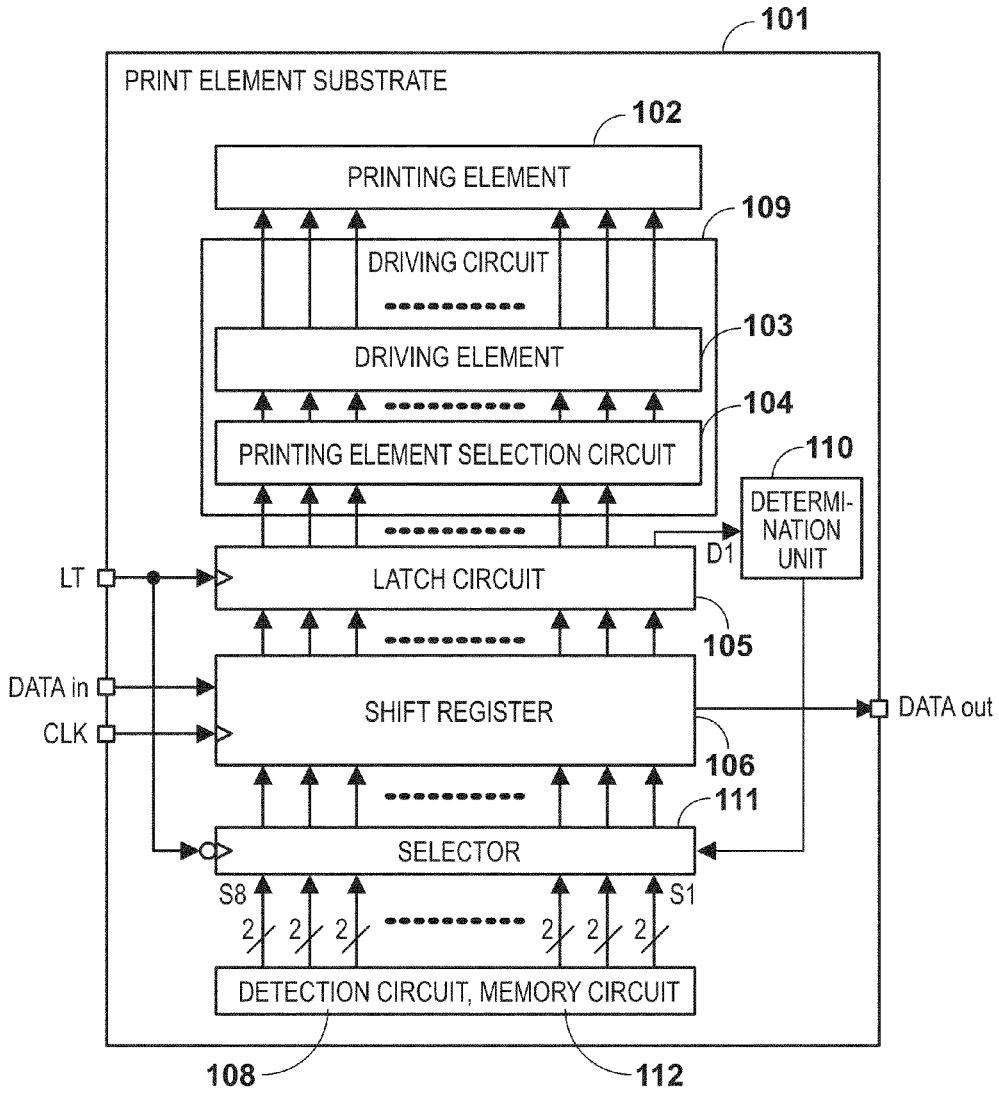
FIG. 11 is a block diagram for explaining the second modification of the circuit arrangement of the print element substrate 50 according to the first embodiment.

FIG. 11 shows the second modification of the print element substrate 50 according to the first embodiment. As shown in FIG. 11, the print element substrate 101 as the second modification of the print element substrate 50 includes the detection circuit 108, a memory circuit 112, the selector 111, and the determination unit 110. The detection circuit 108 is, for example, a temperature detection circuit, and outputs data S1 to S8 of 8 bits, as described with reference to FIG. 9. The memory circuit 112 holds characteristic data of the print element substrate 101.

The selector 111 receives signals output from the detection circuit 108 and memory circuit 112, and selects a signal to be output to the shift register 106 from these signals based on a signal generated by the determination unit 110. The selector 111 in FIG. 11 is identical to the selector 111 in FIG. 10. Based on the value of data D1 output from the latch circuit 105, the determination unit 110 generates a signal for controlling the selector. For example, if the D1 value is 0, the determination unit 110 outputs a signal to select the detection circuit 108 by the selector 111. If the D1 value is 1, the determination unit 110 outputs a signal to select the memory circuit 112 by the selector 111.

(Second Embodiment)

The second embodiment will be explained. The circuit arrangement of a print element substrate 50 according to the second embodiment will be exemplified with reference to FIG. 7.

The second embodiment will explain a case in which m×n printing elements are time-divisionally driven for every m printing elements at n timings. More specifically, m×n printing elements are divided into M groups each formed from n printing elements (groups each containing a predetermined number of printing elements). The time of one sequence is divided at n timings not to simultaneously drive two or more heaters in each group. It is controlled to simultaneously drive m printing elements in accordance with an m-bit print signal within each divided time.

Each printing element 102 is serially connected to a driving element 103, and its driving is controlled based on an input from the gate terminal of the driving element 103. The gate terminal of the driving element 103 receives the output of the logical product of three signals. More specifically, an output from the HE terminal, an output from a decoder 110, and an output from a latch circuit 105 are input. The HE terminal is commonly connected to printing element selection circuits 104. The HE signal input to the HE terminal controls the driving timing of the printing element 102. The printing element 102 is driven if an input from another logical product input terminal becomes "H" during the "H" period of the HE signal.

n output signal lines extending from the decoder 110 are connected to the inputs of the n printing element selection circuits 104 in each group. To select one printing element 102 in each group, one of output signals from the output lines extending from the decoder 110 becomes valid. An output signal from the latch circuit 105 is commonly supplied to the printing element selection circuits 104 in each group to select the group.

Note that the interconnections of the latch circuit 105, a shift register 106, a gate circuit 107, and a detection circuit 108 and the operations of the respective circuits are the same as those in the first embodiment, and a description thereof will not be repeated. The input of the decoder 110 is connected to the latch circuit 105. A signal from the shift register 106 is output to the decoder 110 at the "H" timing of the LT signal.

The decoder 110 validates ("H") one output from it based on a print signal from the latch circuit 105. One wiring line out of n decoder output wiring lines becomes "H". That is, the basic arrangement in the second embodiment is the same as that in the first embodiment except that the decoder 110 and the arrangements of the latch circuit 105 and shift register 106 connected to it are added to the arrangement in the first embodiment.

Figure 7:
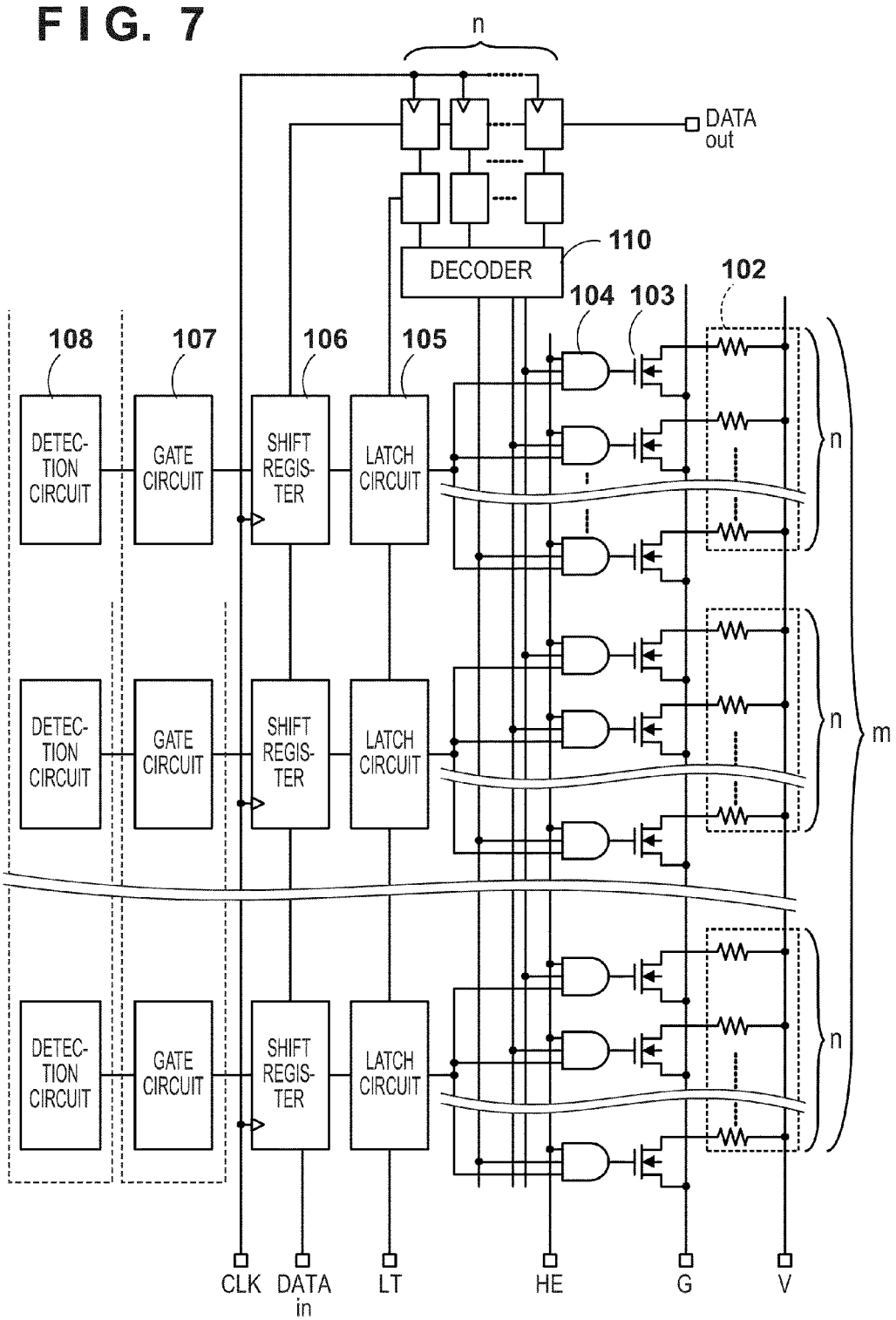
FIG. 7 is a diagram exemplifying the circuit arrangement of a print element substrate 50 according to the second embodiment.
Figure 8:
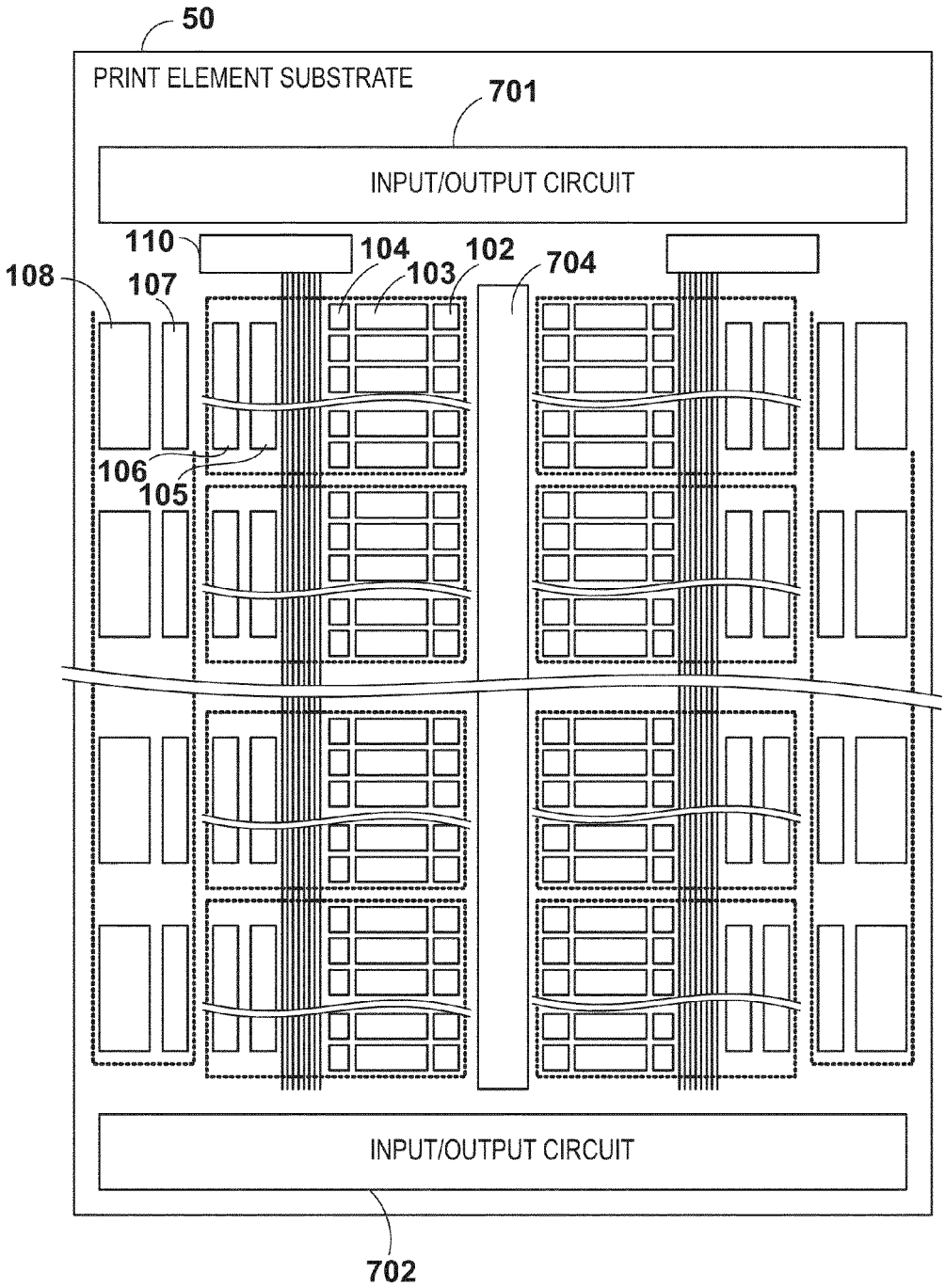
FIG. 8 is a diagram exemplifying the circuit arrangement of the print element substrate 50 shown in FIG. 7.

FIG. 8 is a view exemplifying the layout of the print element substrate 50 shown in FIG. 7. A print element substrate which adopts a method of heating a printing element (heater) to bubble ink supplied onto the upper surface of the heater, and discharging the ink from a nozzle (not shown) arranged on the upper surface of the substrate will be explained.

An ink supply port 704 is formed at the center of the substrate 50. The ink supply port 704 is provided to supply ink from the lower surface of the substrate (the reverse of the paper surface) to the upper surface of the substrate (the obverse of the paper surface). The ink is then supplied to each printing element 102. The circuit arrangements shown in FIG. 7 are symmetrically arranged on the two sides of the ink supply port 704.

The printing elements, that is, heaters 102 are arrayed in line along the ink supply port 704. The driving elements 103 and printing element selection circuits 104 are arranged in correspondence with the respective heaters 102. n heaters 102, n driving elements 103, and n printing element selection circuits 104 form one group. The 1-bit shift register 106 and latch circuit 105 are arranged for each group. Output wiring lines extending from the decoder 110 are arranged commonly to the respective groups in the longitudinal direction of the substrate. The detection circuit 108 and gate circuit 107 are also arranged in correspondence with each group.

In the layout arrangement shown in FIG. 8, the gate circuit 107 and detection circuit 108 are arranged adjacently to the shift register 106. Hence, a wiring line which mutually connects the detection circuit 108 and gate circuit 107, and a wiring line which mutually connects the gate circuit 107 and shift register 106 can be shortened.

This arrangement can efficiently decrease the area occupied by wiring lines, compared to an arrangement in which detection signals from the detection circuit 108 are output to wiring lines individually extending to inputs and outputs. Since the line length can be decreased, delays caused by the parasitic resistance and parasitic capacitance of the wiring line can be decreased. Delays from the detection circuit 108 and gate circuit 107 can be decreased, increasing the data transfer rate.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

For example, in the above-described embodiments, print signals are parallelly output from the shift registers 106 to the latch circuit 105 at the leading edge timing of the latch signal, and detection signals are parallelly input to the shift registers at the trailing edge timing of the latch signal. However, the present invention is not limited to this. It suffices to perform these control operations in synchronism with timings when the signal value of the latch signal transits (to the first value and second value). These timings are arbitrarily the leading and trailing edge timings of the latch signal.

Further, the above-described embodiments use the latch signal as a signal which defines these timings, but the present invention is not limited to this. A new signal may be set to perform the above-described processing based on this signal though the number of wiring lines increases.

This application claims the benefit of Japanese Patent Application No. 2012-027722, filed Feb. 10, 2012, which is hereby incorporated by reference herein in its entirety.

What is claimed is:

1. A print element substrate including a plurality of printing elements, comprising:

a detection circuit configured to detect substrate information of the print element substrate;

a shift register configured to serially input print signals for performing driving control of the printing elements, serial-parallel convert the print signals, and parallelly output the print signals;

a latch circuit configured to latch the print signals parallelly output from the shift register; and a driving circuit configured to drive the plurality of printing elements based on the print signals latched by the latch circuit, wherein detection signals based on the substrate information are parallelly input from the detection circuit to the shift register until serial input of next print signals starts after parallelly outputting the print signals from the shift register to the latch circuit.

2. The substrate according to claim 1, wherein after the detection signals are parallelly input to the shift register, the shift register parallel-serial converts the input detection signals in synchronism with serial input of the print signals, and serially outputs the detection signals.

3. The substrate according to claim 1, wherein the print signals stored in the shift register are parallelly output to the latch circuit at a timing when a signal value of a latch signal transits to a first value, the detection signals are parallelly input to the shift register at a timing when the signal value of the latch signal transits to a second value, and the print signals are serially input to the shift register until the signal value of the latch signal further transits to the first value.

4. The substrate according to claim 1, further comprising a gate circuit configured to parallelly output the detection signals to the shift register, wherein the detection circuit and the shift register are adjacently arranged on the print element substrate to sandwich the gate circuit.

5. The substrate according to claim 4, wherein the plurality of printing elements are divided into groups each containing a predetermined number of printing elements, and the driving circuit time-divisionally drives the printing elements in each group, and the detection circuit and the gate circuit are arranged in correspondence with each group.

* * * * *